US009647310B2

(12) United States Patent
Reza et al.

(10) Patent No.: US 9,647,310 B2
(45) Date of Patent: May 9, 2017

(54) COPLANAR WAVEGUIDE TRANSMISSION LINE STRUCTURE CONFIGURED INTO NON-LINEAR PATHS TO DEFINE INDUCTORS WHICH INHIBIT UNWANTED SIGNALS AND PASS DESIRED SIGNALS

(71) Applicant: Raytheon Company, Waltham, MA (US)

(72) Inventors: Shahed Reza, Boxborough, MA (US); Keith R. Kessler, Andover, MA (US); Christopher M. Laighton, Boxborough, MA (US); Michael F. Parkes, Spencer, MA (US)

(73) Assignee: RAYTHEON COMPANY, Waltham, MA (US)

( * ) Notice: Subject to any disclaimer, the term of this patent is extended or adjusted under 35 U.S.C. 154(b) by 36 days.

(21) Appl. No.: 14/196,678

(22) Filed: Mar. 4, 2014

(65) Prior Publication Data

US 2015/0255847 A1 Sep. 10, 2015

(51) Int. Cl.
*H01P 3/00* (2006.01)
*H01P 1/162* (2006.01)
*H01P 5/04* (2006.01)

(52) U.S. Cl.
CPC ..... *H01P 3/003* (2013.01); *H01P 1/162* (2013.01); *H01P 5/04* (2013.01)

(58) Field of Classification Search
CPC ..... H01P 3/003; H01P 3/006
USPC ..... 333/12
See application file for complete search history.

(56) References Cited

U.S. PATENT DOCUMENTS

| | | | | |
|---|---|---|---|---|
| 5,138,287 | A * | 8/1992 | Domokos et al. | 333/12 |
| 5,173,671 | A | 12/1992 | Wendler et al. | |
| 6,023,209 | A * | 2/2000 | Faulkner et al. | 333/238 |
| 6,040,524 | A * | 3/2000 | Kobayashi et al. | H05K 1/0219 174/262 |
| 6,076,001 | A * | 6/2000 | Das | H01P 1/181 333/161 |
| 8,624,688 | B2 | 1/2014 | Essenwanger | |
| 2006/0119448 | A1 * | 6/2006 | Lee et al. | H01P 3/003 333/5 |
| 2015/0070102 | A1 | 3/2015 | Dai et al. | |

OTHER PUBLICATIONS

U.S. Appl. No. 14/196,691, filed Mar. 4, 2014, 14 pages.

(Continued)

*Primary Examiner* — Benny Lee
(74) *Attorney, Agent, or Firm* — Daly, Crowley, Mofford & Durkee, LLP

(57) ABSTRACT

A microwave structure having an input section for receiving both a common mode signal and a CPW differential mode signal; an output section; and a CPW transmission line, having a center conductor disposed between a pair of coplanar ground plane conductors, connected between the input section and the output section. The conductors of the CPW transmission line are configured to provide the common mode signal a different attenuation in passing to the output section than the CPW transmission line provides to the differential mode signal passing between the input section and the output section.

22 Claims, 5 Drawing Sheets

(56) References Cited

OTHER PUBLICATIONS

T. Gokdemir, S.B. Economides, A. Khalid, A.A. Rezazadeh, I.D. Robertson, Design and Performance of GaAs MMIC Baluns Using Overlaid and Spiral Couplers, Department of Electronic and Electrical Engineering, King's College, Strand, London, IEEE, WE1B-s, pp. 401-404.
Winifred Bakalski, Werner Simburger, Herbert Knapp, Hans-Dieter Wohlmuth, Arpad L. Scholtz, Lumped and Distributed Lattice-type LC-Baluns, Student Paper, Infineon Technologies AG, Munich, Germany, pp. 209-212.
Hakan P. Partal, Ph.D., Advanced Implementations of Microwave Passive Circuits, Dept. of EECS, Syracuse University, ELE 791, Summer 2011, pp. 1-18.
W. Heinrich, J. Gerdes, F.J. Schmuckle, C. Rheinfelder, K. Strohm, Coplanar Passive Elements on SI Substrate for Frequences up to 110 GHz, Short Papers, IEEE Transactions on Microwave Theory and Techniques, vol. 46, No. 5, May 1998, pp. 709-712.
Shimozawa et al., A Parallel Connected Marchand Balun Using Spiral Shaped Equal Length Coupled Lines, 1999 IEEE MTT-S Digest, pp. 1737-1740.
Kenichi Okada, Kazuya Masu, Modeling of Spiral Inductors, Tokyo Institute of Technology, Japan, Apr. 2010, pp. 292-313.
Chiu et al., A Parallel-Strip Balun for Wideband Frequency Doubler, International Journal of Microwave Science and Technology, vol. 2013 (2013), Article ID 89259, pp. 1-4.
Yang H. D., et al., Design and Analysis of On-Chip Symmetric Parallel-Plate Coupled-Line Balun for Silicon RF Integrated Circuits, 2003 IEEE MTT-S Degest, pp. A13-A16.
Shao, et al., Design of a Wideband Balun Using Parallel Strips, IEEE Microwave and Wireless Components Letters, vol. 23, No. 3, March 2013, pp. 125-127.
Response to Office action in U.S. Appl. No. 14/196,691.
Office Action dated Jun. 26, 2015, U.S. Appl. No. 14/196,691, 11 pages.
Office Action dated Feb. 23, 2016, U.S. Appl. No. 14/196,691, 7 pages.

* cited by examiner

COPLANAR WAVEGUIDE TRANSMISSION LINE STRUCTURE CONFIGURED INTO NON-LINEAR PATHS TO DEFINE INDUCTORS WHICH INHIBIT UNWANTED SIGNALS AND PASS DESIRED SIGNALS

TECHNICAL FIELD

This disclosure relates generally to microwave transmission lines and more particular to coplanar waveguide (CPW) microwave transmission lines to provide a different attenuation to an unwanted mode of propagation from that provided to a desired mode of propagation.

BACKGROUND OF THE INVENTION

As is known in the art, a coplanar waveguides (CPW) structure includes: a center conductor disposed over a surface of a substrate; and a pair of ground plane conductors disposed over the surface of the substrate, the center conductor being disposed between the pair of ground plane conductors. Microwave energy fed to an input of the CPW propagates to an output in a differential transmission mode relative to the pair of ground plane conductor with the electromagnetic field being near the surface substrate. CPW has been and continue to be used in wide variety of integrated circuit and circuit board applications. However, being a three conductor system, CPW structures are vulnerable to propagation of unwanted common mode(s). For example, in many applications the integrated circuit having active elements interconnected on a top, or upper, surface of a common substrate and a conductor is disposed on the bottom surface of the substrate for mounting to a heat sink or to a system ground conductor, for example. In this example, a parallel plate region is formed between the conductors on the upper surface, particularly, when larger ground plane conductors are used for the CPW transmission line, and the conductor on the bottom surface.

More particularly, a microwave parallel plate region includes a pair of conductors disposed over opposite surfaces of a substrate. When such parallel plate region is used as a portion of a microwave transmission line, unwanted, parasitic, parallel plate modes may be generated (moding), supported between the pair of conductors, and then transmitted through the parallel plate region. In one application, a substrate may be used to realize a Monolithic Microwave Integrated Circuit (MMIC) chip having an amplifier with a conductor on the bottom of the substrate, for providing a system ground or for soldering to a printed circuit board or heat sink, for example, and conductors on the top of the substrate. In such a chip, transmission lines are used to interconnect elements of the amplifier. As a result of the top and bottom conductors, parallel plate moding may be generated. If the generated moding has frequencies within the bandwidth of the amplifier with magnitudes equal to, or greater than, the forward gain of the amplifier, a portion of the output energy produced by the amplifier may be coupled back to the input of the amplifier providing positive feedback thereby generating unwanted oscillations.

Common mode generation may also result from interference from other sources, such as, for example, coupling of external signals generated by other sources, unbalanced excitation or unbalanced ground paths.

Thus, while CPW transmission uses a differential mode transmission, these other sources can generate common modes that can propagate through the CPW transmission lines as unwanted signals and become a source of parasitic unwanted common mode signals that propagate through the one or more of the center conductors and pair of ground plane conductors and adversely affect the performance and operation of the MMIC.

SUMMARY OF THE INVENTION

In accordance with the present disclosure, a transmission line structure is provided having: a substrate; and a coplanar waveguide transmission line disposed over a surface of the substrate. The coplanar waveguide transmission line includes: a center conductor disposed over a surface of the substrate; and a pair of ground plane conductors disposed over the surface of the substrate, the center conductor being disposed between the pair of ground plane conductors. The coplanar waveguide structure is configured to provide a different attenuation to an unwanted mode of propagation from that provided to a desired mode to propagate.

In one embodiment, the unwanted mode is a common mode of propagation and the desired mode is a differential mode of propagation.

In one embodiment, at least one of the center conductor and the pair of ground plane conductors is configured as an inductor reactive element.

In one embodiment, the pair of ground plane conductors and the center conductor is each spiral shaped.

In one embodiment, the pair of ground plane conductors and the center conductor is each a meander line.

In one embodiment, each one of the center conductor and pair of ground plane conductors provides an inductor to suppress parasitic common mode signal propagation in the center conductor or in either one, or both, of the pair of ground plane conductors.

In one embodiment, a microwave structure includes: an input section for receiving both a common mode signal and a CPW differential mode signal; an output section; and a CPW transmission line, having a center conductor disposed between a pair of coplanar ground plane conductors, connected between the input section and the output section. The conductors of the CPW transmission line are configured to provide the common mode signal a different attenuation in passing to the output section than the CPW transmission line provides to the differential mode signal passing between the input section and the output section.

In one embodiment, the center conductor and the pair of ground plane conductors are each configured as an inductor.

In one embodiment, a capacitor is connected in parallel with the inductor.

With such an arrangement, the structure presents different impedances to the desired differential mode and the unwanted common mode. The structure provides attenuation of the unwanted common mode while allowing the desired differential mode to propagate. Thus, the structure appears as a spiral inductor to the common mode while appears as a matched transmission line to the differential mode. The structure can be used alone or part of a resonant circuit to block the common mode leaving the differential mode transparent to the resonant circuit.

The structure serves as a choke to common mode microwave signals and a CPW transmission line for differential mode microwave signals.

In one embodiment, a resistor is connected in parallel with the inductor.

The resistor is used for dissipating the energy of the unwanted mode signal.

The details of one or more embodiments of the disclosure are set forth in the accompanying drawings and the description below. Other features, objects, and advantages of the disclosure will be apparent from the description and drawings, and from the claims.

BRIEF DESCRIPTION OF THE DRAWINGS

Like reference symbols in the various drawings indicate like elements.

DETAILED DESCRIPTION

Figure 1:
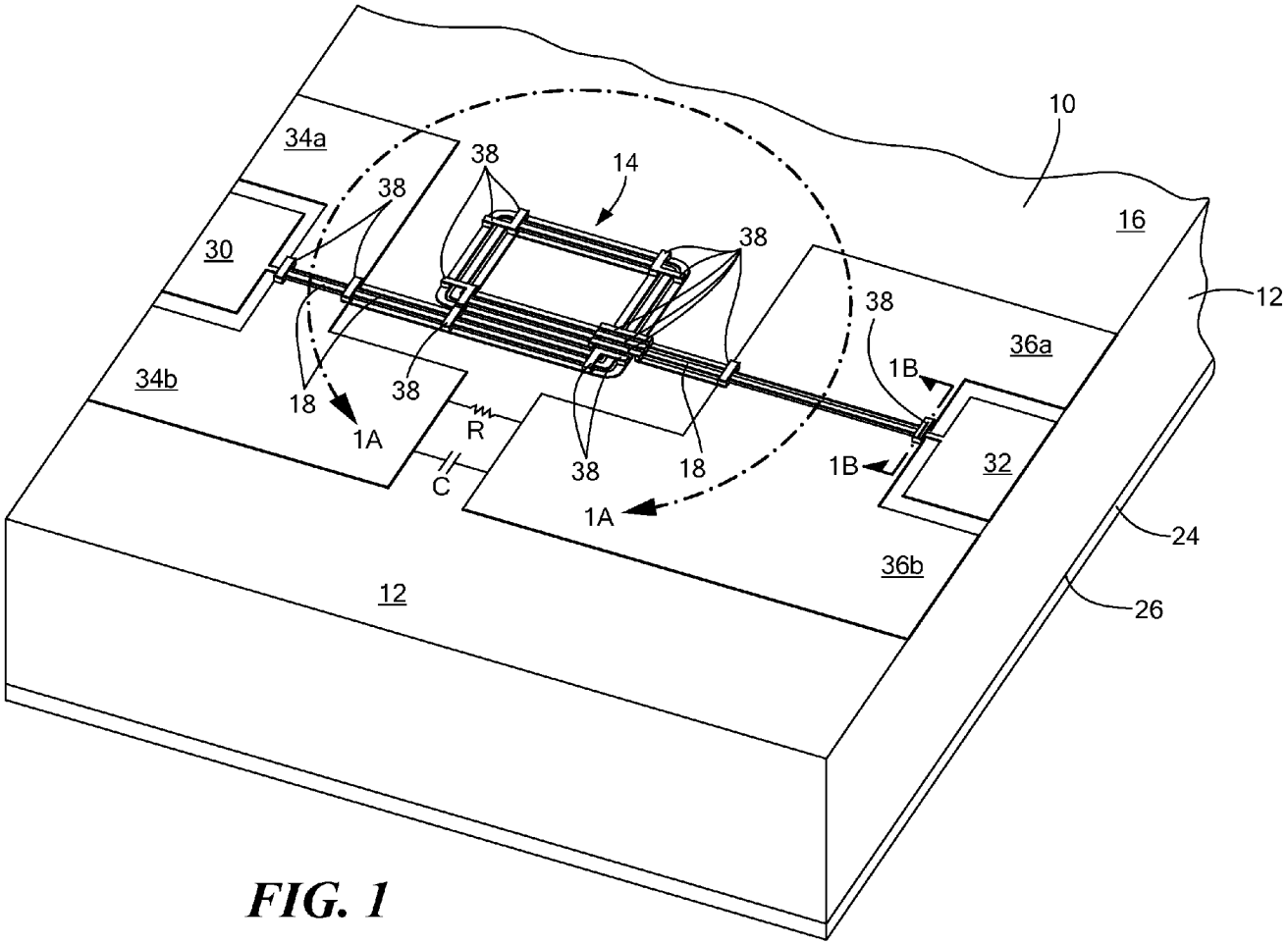
FIG. 1 is a an isometric sketch of a transmission line structure according to the disclosure.
Figure 1A:
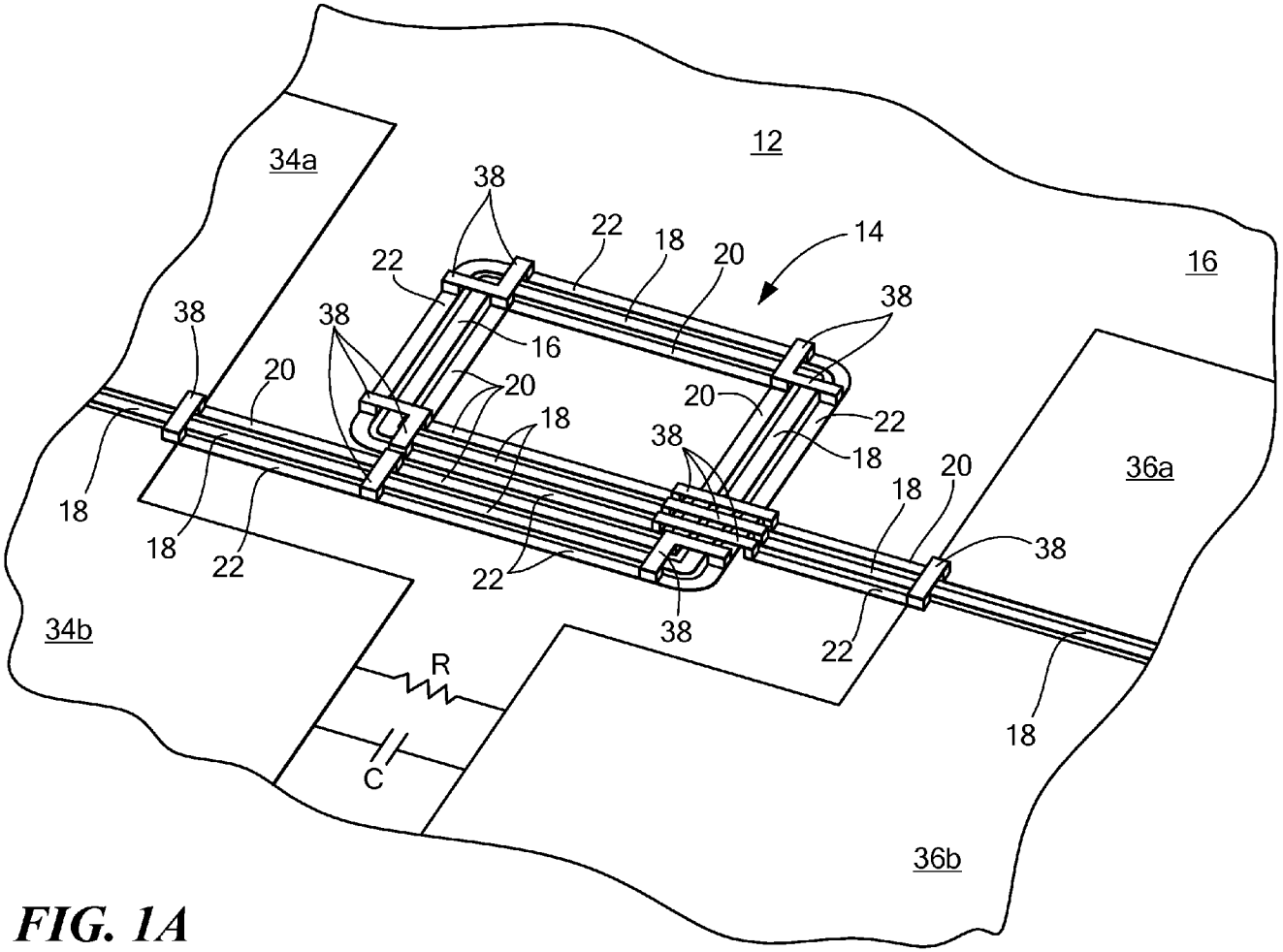
FIG. 1A is an enlarged isometric sketch of a portion of the transmission line structure of FIG. 1, such portion being in the area designated by the arrow 1A-1A in FIG. 1.
Figure 1B:
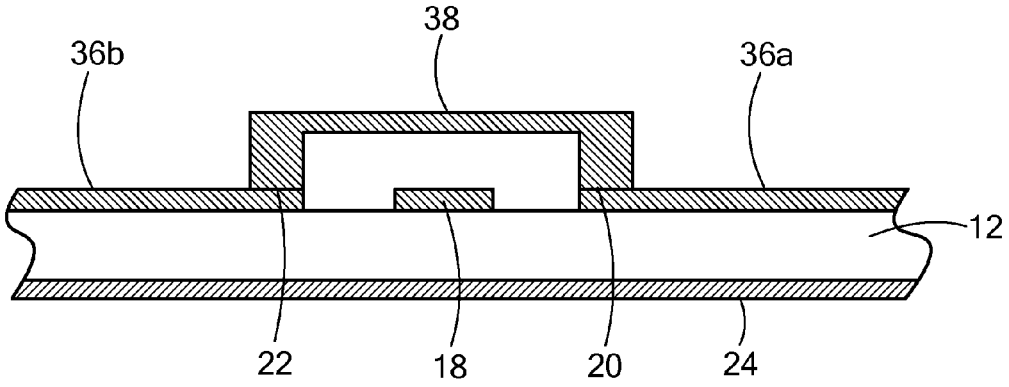
FIG. 1B is a cross sectional, elevation view of a portion of the transmission line structure of FIG. 1, such cross section being taken along line 1B-1B in FIG. 1.

Referring now to FIGS. 1, 1A and 1B, a transmission line structure 10 (FIG. 1) is shown having: an insulating substrate 12 and a coplanar waveguide transmission line 14 (FIGS. 1A and 1B) disposed over an upper surface 16 (FIGS. 1 and 1A) of the substrate 12. The coplanar waveguide transmission line 14 includes: a center conductor 18 disposed over the upper surface 16 of the substrate 12; and a pair of ground plane conductors 20, 22 (FIGS. 1 and 1A) disposed over the upper surface 16 of the substrate 12, the center conductor, or signal line, 18 being disposed between the pair of ground plane conductors, or strips, 20, 22, as shown. At least one of the center conductor 18 and the pair of ground plane conductors 20, 22 is configured as a passive reactive element; here all three conductors 18, 20 and 22 are shaped as a spiral inductor, as will be described. It is noted that here a conductor 24 (FIGS. 1 and 1B) is disposed on the bottom surface 26 (FIG. 1) of the substrate 12. Here, the conductor 24 is used for mounting the structure 10 (FIG. 1) to a heat sink, not shown.

More particularly, the input to the coplanar waveguide transmission line 14 includes a center conductor input pad 30 (FIG. 1) connected to one end of the center conductor 18 and a center conductor output pad 32 (FIG. 1) connected to the other end of the center conductor 18. One end of both ground plane conductors 20, 22 is connected to a corresponding one of a pair of input ground plane pads 34*a*, 34*b*, respectively, as shown, and the other end of each one of the ground plane conductors 20, 22 is connected to a corresponding one of a pair of output ground plane pads 36*a*, 36*b*, respectively, as shown (FIGS. 1 and 1A). It is noted that the ground plane conductors 20, 22 are connected by air-bridges 38 that span over the center conductors 18, as shown (FIGS. 1, 1A and 1B). The structure 10 may be formed using conventional photolithographic-etching processes.

As noted above, at least one of the center conductor 18 and the pair of ground plane conductors 20, 22; here all three conductors 18, 20 and 22 are shaped as a spiral inductor. The spiral inductors are to provide an impedance to the common mode signals to suppress such common mode signals in attempting to pass between the input pad 30 and the output pad 32; however, the three conductors 18, 20 and 22 forming a CPW transmission line, allow differential mode signals at the input pad 30 to pass to the output pad 32 substantially unattenuated. Thus, the structure resembles a spiral inductor, however unlike the common spiral inductor where the signal line only wraps around, in structure two ground conductor strips 20, 22 also follow the signal line 18 and wraps around as well.

It is noted that the ground plane conductors 34*a*, 34*b* are separated from ground plane conductors 36*a*, 36*b* by a portion of the surface of the substrate 12. The ground plane conductors 34*a*, 34*b* is electrically connected to ground plane conductors 36*a*, 36*b* through a resistor R and a capacitor C (FIGS. 1 and 1A) and, the resistor R and the capacitor C being in parallel with the spiral shaped inductors (the spiral shaped conductors 18, 20 and 22). The capacitor C and the spiral shaped inductors (the spiral shaped conductors 18, 20 and 22) form L-C tank circuits tuned to the undesired common mode signals; however, because the CPW transmission line formed by three conductors 18, 20 and 22 provide a differential line (the signal line 18 has its own ground plane lines 20, 22 on either side and on the same surface, differential mode signals pass through the CPW line without being effected by the tank circuits. The resistor R dissipates common mode energy in the tank circuits. FIG. 3A is a schematic diagram of a differential mode equivalent circuit of the transmission line structure of FIG. 2; and FIG. 3B is a schematic diagram of a common mode equivalent circuit of the transmission line structure of FIG. 2.

Figure 2:
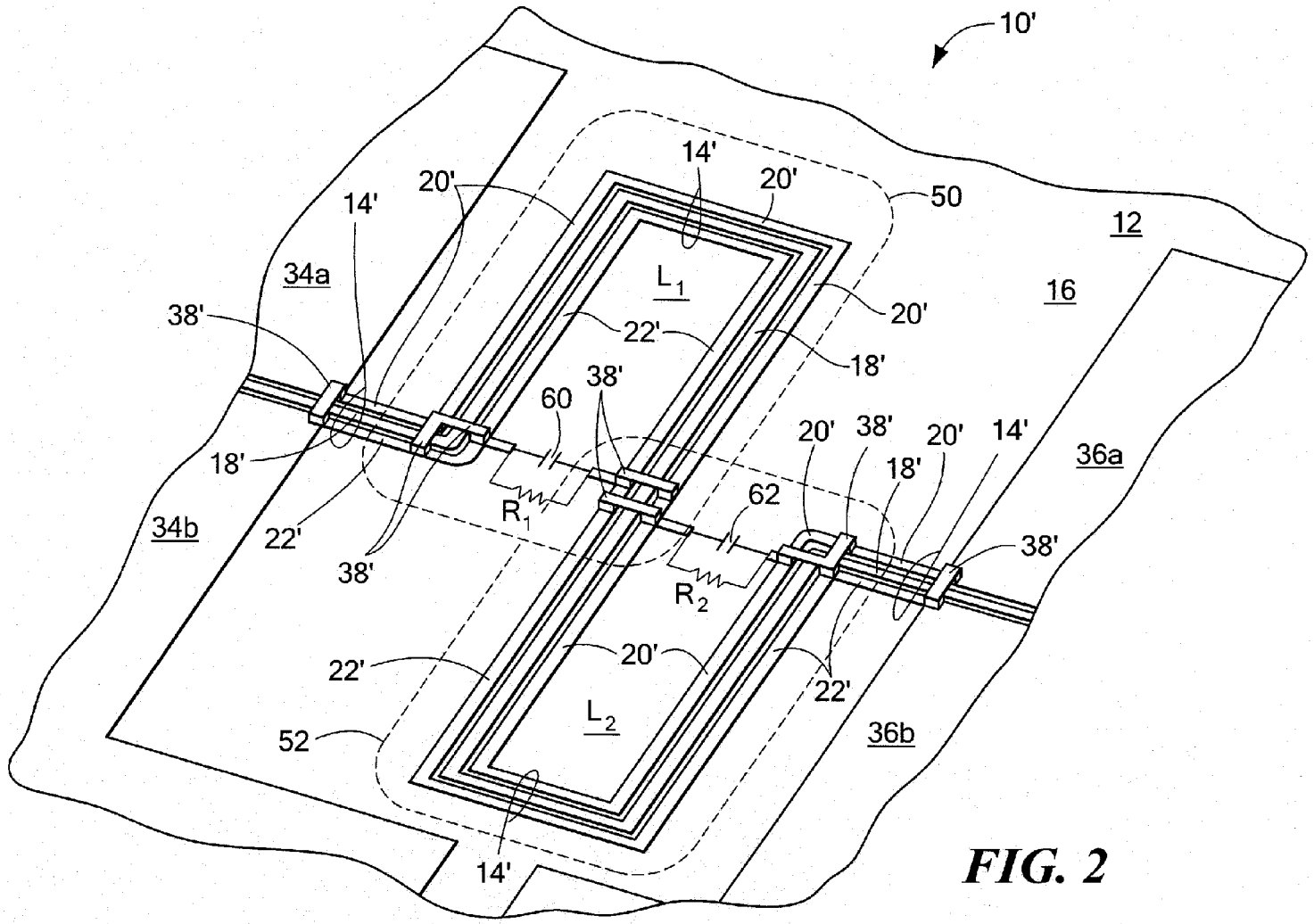
FIG. 2 is an isometric sketch of a transmission line structure according to another embodiment, of the disclosure.
Figure 3A:
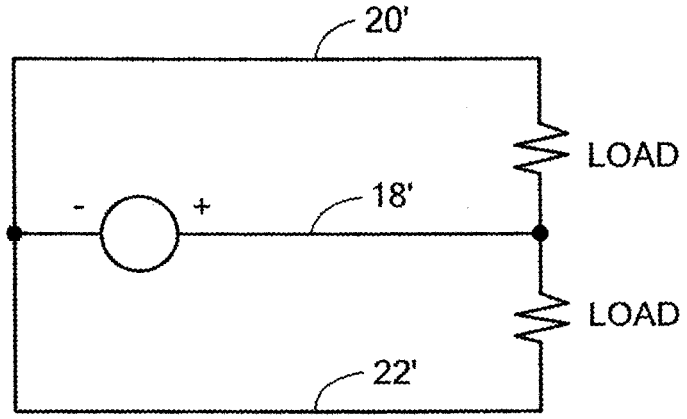
FIG. 3A is a schematic diagram of a differential mode equivalent circuit of the transmission line structure of FIG. 2.
Figure 3B:
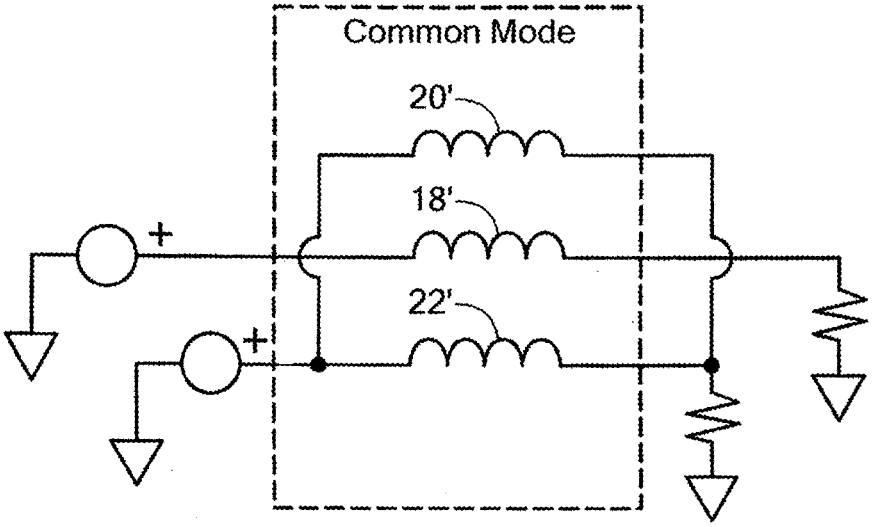
FIG. 3B is a schematic diagram of a common mode equivalent circuit of the transmission line structure of FIG. 2.

Referring now to FIG. 2, a coplanar waveguide transmission line 14' includes: a center conductor 18' disposed over the upper surface 16 of the substrate 12; and a pair of ground plane conductors 20', 22' disposed over the upper surface 16 of the substrate 12, the center conductor, or signal line, 18' being disposed between the pair of ground plane conductors, or strips, 20', 22', as shown. At least one of the center conductor 18' and the pair of ground plane conductors 20', 22' is configured as a passive reactive element; here all three conductors 18', 20' and 22' are shaped as a meander line inductor, as will be described. It is noted that the ground plane conductors 20', 22' are connected by air-bridges 38' that span over the center conductors 18', as shown. The structure 10' may be formed using conventional photolithographic-etching processes. Thus, here there are two, serially connected inductors L1 and L2 formed by each one of the three conductors 18', 20' and 22'. Capacitors 60, 62 are connected in parallel with each corresponding one of the inductors L1, L2 forming a pair of serially connected L-C resonant tank, circuits 50, 52, respectively as shown. These tank circuits 50, 52 are tuned to the undesired common mode signals; however, because the CPW transmission line formed by three conductors 18', 20' and 22' provide a differential line (the signal line 18' has its own ground plane lines 20; 22' on either side and on the same surface, differential mode signals pass through the CPW line without being effected by the tank circuits 50, 52. Resistors R1 and R2 are connected in parallel with L-C tank circuits 50, 52, respectively, to dissipate common mode energy in the tank circuits 50, 51.

FIG. 3A is a schematic diagram of a differential mode equivalent circuit of the transmission line structure of FIG. 2 having a pair of ground plane conductors 20', 22' and a center conductor 18' configured to connect to loads. FIG. 3B is a schematic diagram of a common mode equivalent circuit of the transmission line structure of FIG. 2 having a pair of ground plane conductors 20', 22' and the center conductor 18'.

A number of embodiments of the disclosure have been described. Nevertheless, it will be understood that various modifications may be made without departing from the spirit and scope of the disclosure. Accordingly, other embodiments are within the scope of the following claims.

What is claimed is:

1. A transmission line structure having an input port and an output port, comprising:

a strip center conductor disposed between a pair of strip ground plane conductors;

wherein the strip center conductor and the pair of strip ground plane conductors is each configured as an inductor, the strip center conductor and the pair of strip ground plane conductors each having an input connected to the input port and each having an output connected to the output port;

wherein the strip center conductor and pair of strip ground plane conductors maintain a mutual parallel relationship as the strip center conductor and the pair of strip ground plane conductors each extend in side-by-side relationships along continuous, non-linear, parallel paths from the input port of the transmission line structure to the output port of the transmission line structure;

wherein each inductor is configured to inhibit an unwanted signal from passing therethrough; and wherein the strip center conductor and the pair of strip ground plane conductors are configured to form a coplanar waveguide (CPW) transmission line to pass a desired signal at the input port to the output port.

2. The transmission line structure recited in claim 1 wherein the unwanted signal is a common mode signal and the desired signal is a differential mode signal.

3. The structure recited in claim 1 wherein the center strip conductor and the pair of strip ground plane conductors maintain a mutual parallel relationship as the center strip conductor and the pair of strip ground plane conductors each follow a respective one of the non-linear paths from the input port to the output port.

4. The transmission line structure recited in claim 1 wherein the unwanted signal is a common mode of propagation and the desired signal is a differential mode of propagation.

5. The transmission line structure recited in claim 1 wherein each inductor is configured as having a self-inductance and wherein the self-inductance inhibits the unwanted signal from passing through the configured inductor.

6. The transmission line structure recited in claim 1 wherein the pair of strip ground plane conductors and the strip center conductor is each spiral shaped.

7. The transmission line structure recited in claim 1 wherein the pair of strip ground plane conductors and the strip center conductor is each a meander line.

8. A coplanar waveguide (CPW) transmission line structure for coupling a differential mode microwave signal between an input port and an output port while suppressing common mode signals at the input port, comprising:

a strip center conductor disposed between a pair of strip ground plane conductors;

wherein the strip center conductor and the pair of strip ground plane conductors maintain a mutual parallel relationship as the strip center conductor and the pair of strip ground plane conductors each extend in side-by-side relationships along continuous, non-linear, parallel paths from the input port of the coplanar waveguide transmission line to the output port of the coplanar waveguide transmission line;

wherein the strip center conductor and the pair of strip ground plane conductors is each configured as an individual inductor, each said individual inductor being configured to suppress the common mode signals from passing through each said individual inductor to provide the suppression of the common mode signals at the input port while the strip center conductor and the pair of strip ground plane conductors are configured to provide the CPW transmission line structure and pass the differential mode microwave signals between the input port and the output port through the CPW transmission line structure.

9. A transmission line structure, comprising:

a coplanar waveguide (CPW) transmission line for coupling a microwave signal between an input port and an output port, comprising: a center conductor; and a pair of ground plane conductors; wherein the center conductor and the pair of outer conductors maintain a mutual parallel relationship as the center conductor and the pair of outer conductors each follow a non-linear path from an input of the coplanar waveguide transmission line to an output of the coplanar waveguide transmission line, and;

wherein the center conductor and the pair of ground plane conductors are each configured to provide a different attenuation to an unwanted signal propagation between the input port and the output port from an attenuation provided to a desired signal propagation from the input port to the output port; and wherein each one of the center conductor and pair of ground plane conductors provides an inductor between the input port and the output port to suppress the unwanted signal propagation in the center conductor or in either one, or both, of the pair of ground plane conductors while the center conductor and the pair of ground plane conductors pass the desired signal propagation between the input port and the output port through the CPW transmission line comprised of the strip center conductor and the pair of strip ground plane conductors.

10. A transmission line structure, comprising:

an input section for receiving both a common mode signal and a differential mode signal;

an output section;

a coplanar waveguide transmission line, having a center conductor disposed between a pair of coplanar ground plane conductors, connected between the input section and the output section;

wherein each one of the center conductor and the pair of ground plane conductors is configured into an inductor between the input section and the output section, each inductor having a self-inductance, the self-inductance inhibiting the common mode signal from passing through said each inductor between the input section and the output section while the center conductor and the pair of coplanar ground plane conductors pass the differential mode signal between the input section and the output section through the coplanar waveguide transmission line;

wherein each one of the center conductor and the pair of ground plane conductors maintains a mutual parallel relationship as the center conductor and the pair of ground plane conductors each follow a non-linear path from the input section of the coplanar waveguide transmission line to the output section of the coplanar waveguide transmission line.

11. The transmission line structure recited in claim 10 wherein the pair of ground plane conductors and the center conductor is each spiral shaped.

12. The transmission line structure recited in claim 10 wherein the pair of ground plane conductors and the center conductor is each a meander line.

13. A microwave structure, comprising:

an input section for receiving both a common mode signal and a CPW differential mode signal;

an output section;

a CPW transmission line, having a center conductor disposed between a pair of coplanar ground plane conductors, connected between the input section and the output section, the center conductor and the pair of ground plane conductors each being configured as an inductor, the center conductor and the pair of coplanar ground plane conductors of the CPW transmission line being configured to provide the common mode signal with a different attenuation in passing to the output section than the CPW transmission line provides to the differential mode signal passing between the input section and the output section;

and including a capacitor connected between the input section and the output section.

14. The microwave structure recited in claim 13 wherein the capacitor, the center conductor and the pair of coplanar ground plane conductors are disposed on a common substrate.

15. A coplanar waveguide (CPW) transmission line comprising three parallel strip conductors, one of the three parallel strip conductors being disposed between a pair of outer ones of the three parallel strip conductors, each one of the three parallel strip conductors following a non-linear path and each one of the three parallel strip conductors being configured as a respective inductor and wherein the outer ones of the three parallel strip conductors are directly connected one to the other.

16. A transmission line structure having an input port and an output port, comprising:

a substrate;

a coplanar waveguide transmission line disposed over a surface of the substrate, the coplanar waveguide transmission line transmitting differential mode signals, comprising:

a center conductor disposed over the surface of the substrate; and a pair of ground plane conductors disposed over the surface of the substrate, the center conductor being disposed between the pair of ground plane conductors;

wherein each one of the center conductor and pair of ground plane conductors maintains a mutual parallel relationship as the center conductor and the pair of outer conductors each follow a non-linear path from an input of the coplanar waveguide transmission line to an output of the coplanar waveguide transmission line;

wherein the center conductor and the pair of ground plane conductors is each configured as an individual inductor having a self-inductance, each individual inductor having an input connected to the input port and an output connected to the output port;

wherein the self-inductance inhibits a respective unwanted signal from passing through the individual inductor; and wherein the coplanar waveguide (CPW) transmission line passes a desired signal at the input port to the output port.

17. The transmission line structure recited in claim 16 wherein the pair of ground plane conductors and the center conductor is each spiral shaped.

18. The microwave structure recited in claim 16 wherein the unwanted signal is a common mode signal and including a capacitor connected with the inductor to provide a resonant circuit tuned to the common mode signal to suppress the common mode signal.

19. The transmission line structure recited in claim 18 wherein the capacitor, the center conductor and the pair of coplanar ground plane conductors are disposed on the substrate.

20. The transmission line structure recited in claim 18 including a resistor connected in parallel with the capacitor.

21. The transmission line structure recited in claim 20 wherein the resistor, the center conductor and the pair of coplanar ground plane conductors are disposed on the upper surface of the substrate.

22. A coplanar waveguide transmission line, comprising: a center conductor disposed between a pair of outer conductors, the center conductor and the pair of outer conductor each providing a respective inductor, the center conductor and the pair of outer conductors maintaining a mutual parallel relationship as the center conductor and the pair of outer conductors each follow a non-linear path from an input of the coplanar waveguide transmission line to an output of the coplanar waveguide transmission line and wherein the pair of outer conductors are directly connected one to the other.

* * * * *